United States Patent [19]

Lagendijk

[11] Patent Number: 4,463,526

[45] Date of Patent: Aug. 7, 1984

[54] STIFF GIRDER CONSTRUCTED WITH FLEXIBLE CABLE ROPES

[76] Inventor: Johannes Lagendijk, Octant 197, Sterrenburg, 3328 SL Dordrecht, Netherlands

[21] Appl. No.: 342,194

[22] Filed: Jan. 22, 1982

[30] Foreign Application Priority Data

Jan. 23, 1981 [NL] Netherlands ..... 8100332
Jul. 27, 1981 [NL] Netherlands ..... 8103524

[51] Int. Cl.[3] ..... F04B 7/00
[52] U.S. Cl. ..... 52/83; 52/223 R
[58] Field of Search ..... 52/83, 80, 223

[56] References Cited

U.S. PATENT DOCUMENTS 2,693,195 11/1954 Frieder et al. ..... 52/83 X
3,410,039 11/1968 Brezina ..... 52/83 X

FOREIGN PATENT DOCUMENTS 662032 4/1963 Canada ..... 52/83
916583 8/1954 Fed. Rep. of Germany ..... 52/83
1285104 1/1962 France ..... 52/83
6801792 8/1968 Netherlands .
7018039 6/1971 Netherlands .
434163 11/1974 U.S.S.R. ..... 52/83
554372 4/1977 U.S.S.R. ..... 52/83
600267 3/1978 U.S.S.R. ..... 52/83
605917 5/1978 U.S.S.R. ..... 52/83

*Primary Examiner*—J. Karl Bell
*Attorney, Agent, or Firm*—Young & Thompson

[57] ABSTRACT

The invention is concerned with a stiff flat girder which basically consists of a top- and a bottom chord (4*a,* 3*b*), compression members (ab) between and diagonal bracings (1*a,* 3*a,* 2*b,* 4*b*) in the spacings (a, b), in which both chords and all diagonal bracings are made of flexible cable/rope. It is preferred to let the main cables (1*a,* 1*b;* 2*a,* 2*b;* 3*a,* 3*b;* 4*a,* 4*b*) continue uninterrupted from one end (L) to the other (R) between the fixed supporting mountings (Lp, Rp; Lq, Rq), whereby the main cables (1, 2, 3, 4) at least once follow the direction of a diagonal bracing (1*a,* 3*a,* 4*b,* 2*b*). Furthermore it is preferred to have one cable of the top chord continue endlessly in one cable of the bottom chord, the cable circuit (4*a,* 4*b,* 34R, 3*b,* 3*a,* 34L; 1*a,* 1*b,* 12R, 2*b,* 2*a,* 12L)formed being guided round the fixed mountings with controlled friction. A stiff, intrinsically safe, light girder structure is formed, allowing a great variety of architectural shapes, applicable for small up to the largest spans.

10 Claims, 12 Drawing Figures

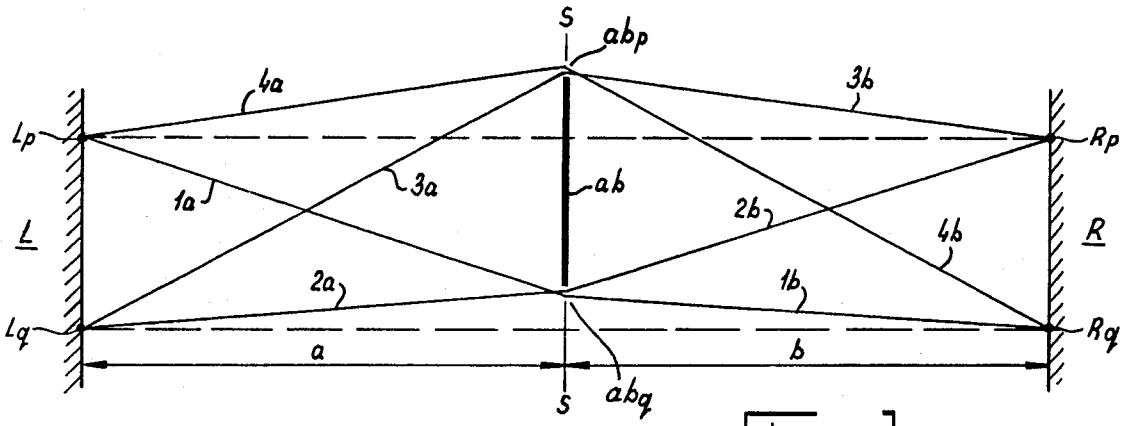
Fig-1
Fig-2
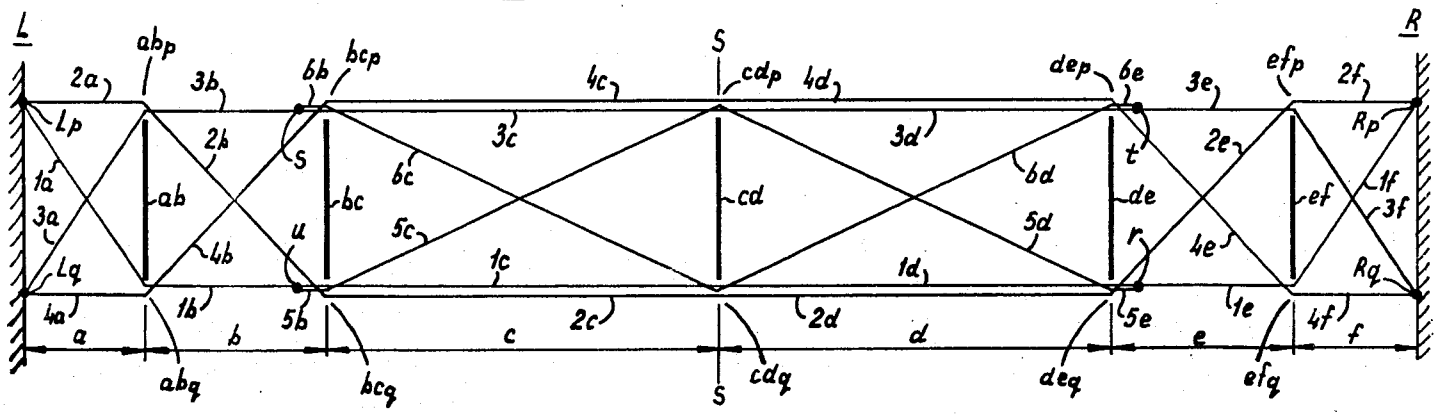

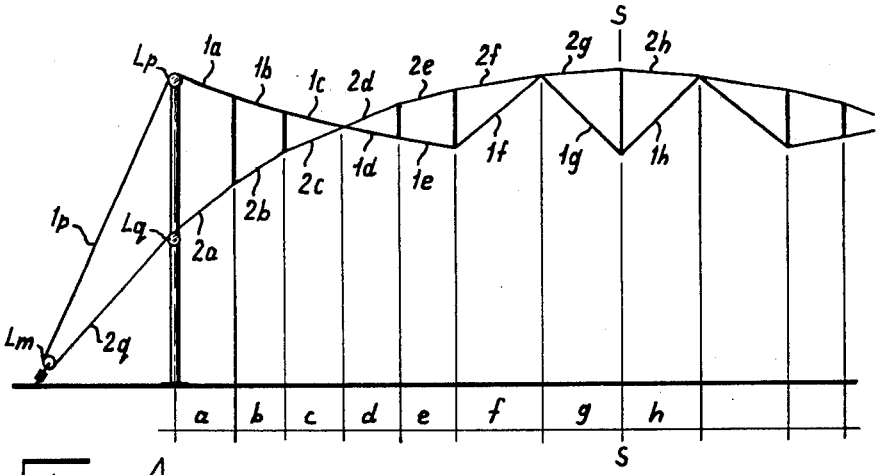
fig-4a
fig-4b
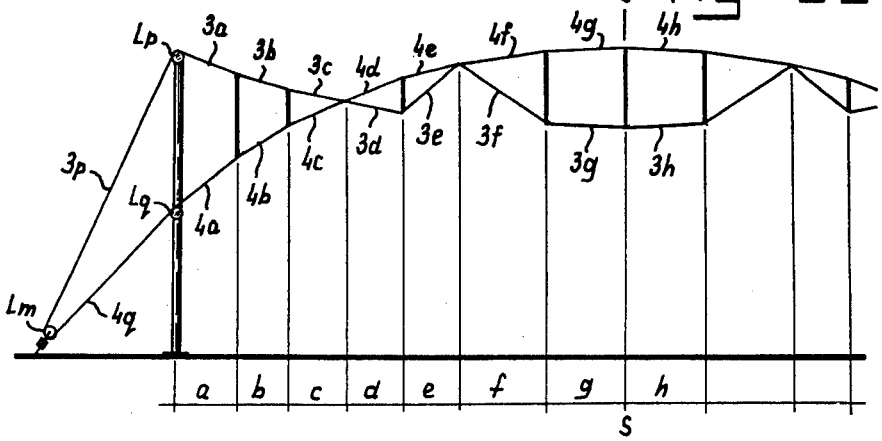
fig-4c
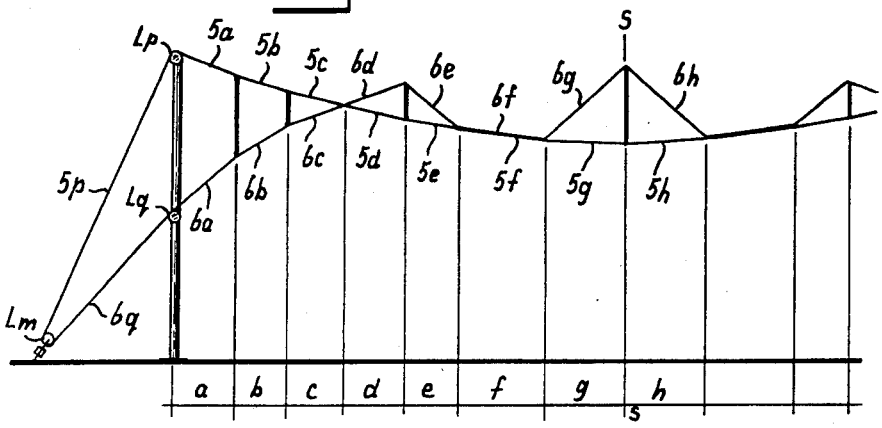

STIFF GIRDER CONSTRUCTED WITH FLEXIBLE CABLE ROPES

The invention relates to a stiff flat girder with at least two spacings, consisting of a top- and a bottom chord, compression members between and diagonal bracings in the spacings, with at least four fixed mountings, two of which are at each end, in which the fixed mountings are situated in the plane of the girder and the load acts in the plane of the girder and substantially perpendicular to the girder and in which the fixed mountings are adapted to withstand in a direct or indirect way, apart from the service loading, tensional forces in the direction of the girder too.

Stiff flat girders are generally supported at their ends on fixed mountings, in which fixed mountings they also may be clamped. In both cases in the girder a relatively large number of members will be loaded with compression. The others are tension-loaded. In case of altering load conditions, like for instance wind loads, certain members may be alternately loaded with compression or tension. All members which ever will be compression-loaded should be sufficiently stiff against yield and in practice stiff members are used with a sufficiently high resistance against yield. Of course the known safety coefficients are applied; however, in case a compression member nevertheless should yield and also in case a tension-loaded member should collapse, the whole girder collapses and is able to draw with its neighbouring girders due to overload and loadings outside its plane.

The invention aims at a simpler and generally safer girder, which for the greater part is built up with flexible cables/ropes. Nevertheless a girder becomes available which is stiff in its plane. The girder according to the invention is characterized in that the top chord and the bottom chord of the girder and the diagonal bracings each consist of at least one flexible cable/rope, in that—excluding the fixed mountings—stiff compression members acting as struts are fitted between the top and bottom chord-cables on those corresponding points-of-intersection in which diagonal bracing cables join the top and bottom chord-cables.

It will be evident that, since flexible cables cannot withstand compression, all cables in the girder should be pre-stressed such that under all practical circumstances of service always a tension force will be retained in each cable, with the exception of so-called zero-cables. The girder according to the invention requires at least four mixed mountings, two of which are at each end, which fixed mountings are positioned in the plane of the girder. Apart from the service loading, the fixed mountings shall have to withstand tension forces in the direction of the girder. It is outside the scope of the invention, in which way said tension forces are led from the fixed mountings in a direct or indirect way to the ground.

Only the compression members between the top chord and bottom chord are executed as yield resistant compression members when applied in the girder according to the invention. Said compression members are situated in such positions or points of intersection in the girder (points-of-change-of-direction), in which diagonal bracing cables join the top- or bottom chords. The compression members, acting as struts, subdivide the girder into a number of spacings. The number of spacings of a girder according to the invention will generally be even, but an uneven number is possible as well.

According to a preferred embodiment, cables run uninterruptedly between mutually facing fixed mountings as main cables, following at least once the direction of a diagonal bracing. Thanks to the uninterrupted continuation of main cables between the fixed mountings unnecessary connections between cables are avoided. This reduces cost considerably and simplifies the design as well. In case of larger spans with several spacings, several cables may run parallel to each other in the top- and bottom chords. This number may vary from spacing to spacing, whereas diagonal bracings may consist of several parallel cables as well. Since such main cables follow at least once the direction of a diagonal bracing passing along points of intersection, such main cables contributes to the stiffening of the girder.

From calculations with regard to the loads due to the net weight, the roof structure, snow- and wind loadings, thermal influences inside and outside the building or shadow and sun sides, the necessary pre-tension for each cable can be fixed such that in each cable under all service conditions tension forces are maintained. From these calculations the value of the compression forces becomes available as well, to which the strut-like stiff compression members are subjected.

At the points of intersection (points-of-change-of-direction), i.e. at the ends of all compression members, all passing cables continue. Exclusively in order to keep the compression members definitely in the correct position and on the right spot, according to a preferred embodiment, at the points of intersection at the ends of each stiff compression member the cables passing said points are fixed at said points to the compression members, for instance by means of a hardening plastic material or with a clamping means.

In case it follows from the calculations that it would be desirable to subdivide one or more spacings into shorter spacings and/or in case the load in certain parts of the continuous main cables would become too high, then, according to a preferred embodiment, one or more secondary cables are applied, which at least once diagonally change over from a point of intersection on the one chord to a point of intersection on the other chord, whereby at least one end of the secondary cable in a tension-resistant way is connected to a main cable, for instance by means of cable clamps. Said latter connection, for instance with the cable clamps, is always joined to a main cable, in order to ensure that the compression members never can be loaded in a direction more or less perpendicular to their centerline in the plane of the girder. In doing so any risk of unwanted displacement of the compression members is avoided.

Furthermore it is preferred that the stiff compression members are placed substantially perpendicular to the chords.

The stiff girder according to the invention allows a large flexibility in constructive and architectural design. For instance the girder may be designed as a roof-truss, in which case the bottom chord may show an upward vaulting as well, which often is wanted for esthetic reasons. When several spacings are used, it is possible as well to design the top chord as a roof-truss with varying angles over its length and even with opposing angles in certain spacings. This may be of advantage with a view of lighting, ventilation, discharge of rainwater, etc.

In contrast to the existing stiff lattice girders, built with stiff members, the girder according to the invention uses only a minimum of compression-loaded members. Since the other "members" consist of flexible cables/ropes, which are tension-loaded, it becomes possible to use only a minimum of material. In contrast to comparable known stiff girders, built from stiff members, the girder according to the invention in the majority of cases will be appreciably lighter in weight and cheaper as well, which is partly due to the fact that a great number of connecting points consists of nothing more than the guiding of one or more cables round the ends of the compression members at the points of intersection.

An additional great advantage of the girder according to the invention is formed by the fact that it is characterized by a great safety against collapse. If, in fact, one of the cables would be loaded by such an overload that it is extended more than calculated and possibly even passes the yield stress, the pre-tension in this and in other cables is automatically reduced due to the occurring change of direction of the cables. The latter reduction of tension loading reacts in a positive sense on the overload cable and reduces its load. Although the girder will undergo due to this a slight change of shape and in case of the application of a stiff roof covering cracks may occur in the roof, the above described intrinsic safety will safeguard the construction against a total collapse. This characteristic provides an additional possibility to adopt still lighter constructions.

It will be evident to the expert that also assemblies of stiff flat girders according to the invention becomes available in that a number of at least three flat girders are combined by at least partially joining the top chord of one girder with the bottom chord of another girder, so that three-dimensional girders of triangular or rectangular cross-section may be formed.

A further important advantage of the girder according to the invention consists of the simple production in the factory and assembly on the location of erection and the transport in between. This is characterized by the following steps:

production of each individual cable complete with its end-connections to size according to the calculated design;

production of the compression members;

straight laying out in a flat plane, like an assembling floor, of all cables and compression members according to the designed direction or position in the proper place;

fitting of the cables to the end of the compression members, and of the (ends of the) secondary cables to the main cables with clamps or the like, all the above according to the design;

rolling up the assembled girder (like a rope ladder) on a reel;

off-reeling the girder after transport to the location of erection and connecting the girder to the fixed mountings of the carrying structure;

post-tensioning of the mountings and permanent clamping of the cables to the compression member according to the calculated stretch of the individual cables up to the service tensions.

As is the case with classical stiff lattice girders, for which each stiff member is pre-machined, pre-drilled or welded to the correct length, the different cables of the girder according to the invention can be produced in the factory together with their end-connections exactly according to the calculated design. On a flat assembling floor all cables and compression members are laid out on the calculated place, following the designed lay-out. At all points of intersection at the ends of the compression members the main- and secondary cables are fitted to the compression members. The ends of the secondary cables, if present, are fitted as well with the help of cable clamps or the like to the main cables. After pre-tightening, the whole assembly may be wound on a reel like a rope ladder, after which transport to the location of erection will be simple. Girders of considerable length which finally will become stiff girders, can be easily transported in this way. At the location of erection the ends of all main cables are fitted to the corresponding fixed mountings, the girder still being untensioned. It is also possible to make use of an already present or auxiliary floor at the location of erection to assemble the girder on it. As a final step the fixed mountings are post-tensioned according to the calculated stretch of the individual cables up to the service tension. Now the girder has adopted its design shape and is readily loadable.

In many cases the girder according to the invention will be connected to four fixed mountings, but it falls within the scope of the invention that a larger number of fixed mountings may be adopted.

The above described girder can be made with different shapes, from a simple roof-truss up to a large span, including a parabolic girder. Besides the advantages as described above, among others consisting of manufacture in a factory, the girder also has certain disadvantages, which show themselves more pronounced in the case of larger and more complicated girders. The girder consists of a certain number of individual main cables which have to be made, assembled and tensioned one after the other. With said design the service tension between the top- and bottom chord may attain very different values. It is known that for girders a great variety of constructions is possible. For a number of these, more especially in cable-design, a preferred embodiment of the invention aims to reduce the number of cables considerably by further equalizing the tension loadings in the cables.

This embodiment is characterized in that each time one of the main cables of the top chord and one of the main cables of the bottom chord endlessly continue into each other, being guided round the fixed mountings with controlled friction, and in that at least one tensioning means is included in each of said endles cablecircuits.

By having the main cable in the top chord and in the bottom chord continue endlessly in each other, even if they cross each other, and by guiding them with controlled friction round the fixed mountings, it becomes possible that under all conditions of loads one and the same tension force acts in the cables. A far better use of the material becomes possible and the number of tensioning points is reduced considerably. After the cable has been stretched in the factory it can not only be closed to form the endless circuit, but it can be marked at those spots where the points of intersection will be located in the final girder assembly. At these spots the stiff compression members are connected to the top- and bottom chords. But also the points of change of direction of each cable can be marked in advance. At the location of erection the cables are laid out and all connections at the marked spots can be made, after which the assembly is ready to be lifted and connected to the fixed mountings.

In many cases all or almost all cables which form the top- and bottom chords, and which follow the diagonals as well, can form the girder in its entirety. By using a number of endless cables between the fixed mountings at both sides of the girder and by having these cables partially run parallel to each other, but partially also along different diagonal bracings, it is possible to construct with only a reduced number of cables a stiff girder up to the largest dimensions.

In order to avoid that collapse of one of the cables would affect all parts of the girder, it is already known to adopt safety measures thanks to which a catch will come in action after relaxation of said cable over a short distance, holding the construction in a safe way upright, although certain deformations may occur which may lead to cracks in the roof covering. The whole structure, however, remains stable and upright.

According to another preferred embodiment the tensioning means of each endless main cable circuit consists of at least one additional adjustable fixed mounting which is situated in the endless cable circuit between the fixed mountings at the same end of the girder and round which the cable circuit is guided with controlled friction. More especially it is of advantage to make this additional fixed mounting independent from the foundation, in order to reduce the bending load in for instance a supporting column, with the result that said column will substantially be loaded in compression only.

The above described endless cable circuits are especially of advantage with smaller and simpler spans. For larger the manufacture and assembly may become difficult. Furthermore it is known that a cable may be loaded considerably less, if it is subjected to varying bending, as for instance when cables are applied in hoisting equipment which cables are led over drums and sheaves. A comparable kind of bending may act in the fixed mountings with controlled friction introduced in the cable circuits, which have to lead to a comparable reduction of the permissible loading of the cable.

Retaining the functional advantages of the endless cable circuits with the equal loading, said disadvatages can be cured by interrupting the cables and the fixed mountings and by connecting them with known means again with controlled friction to pivoting levers, which replace those parts of the cable which would otherwise undergo repeated bending. These levers thus act as pivoting fixed mountings. The unavoidable small extension or shortening of the cables during assembly and more especially during service impart a pivoting motion to the levers, but the cables undergo no variable bending. Thus they remain loadable to the maximum tension allowed for static application.

In the girder according to the invention it is of importance that the cables passing the points of intersection at the ends of the compression members be fixed to them in a simple and safe manner. During assembly, mutual shifting of the cables and of the cables with regard to the compression members should remain possible, but after final assembly a sufficiently strong clamping force should be attainable for service conditions, avoiding mutual shift of the cables or shift in relation to the compression members under normal service conditions. According to the invention the compression members, formed by a hollow square section-member, are characterized in that the connecting structure between the end of the compression member and the cables passing said end, consist of a cable-clamp, of which the two mutually pivoting halves form a female end part adapted to be inserted into the compression member, in that the side of the end part adjacent the clap conically opens up to a width which wedges into the compression member, in that the end extending from the compression member forms two clamping-jaws for holding at least one cable, and in that the cable clamp is provided with a cooperating wedge-and-slot assembly in order to achieve a slight pre-assembling clamping action by insertion of the wedge, before the conical part of the female end permanently is inserted into the compression member beam in order to increase the preclamping-to the permanent service-clamping-force.

Since at the different points of intersection or connecting points within the girder different numbers and/or different cable types may pass, a preferred embodiment is characterized in that the cable-clamp has clamping-jaws of such internal width, that a pair of cable protecting fitting-blocks are inerchangeably enclosed between them, said fitting blocks having grooves adapted to the number and size of the passing cables to be clamped.

With the help of the following description and accompanying drawings preferred embodiments of the invention are explained in more detail.

FIG. 1 shows a stiff flat girder according to the invention, roof-truss-shaped with two spacings.

FIG. 2 shows a straight stiff flat girder according to the invention with six spacings and secondary cables.

Figure 3:
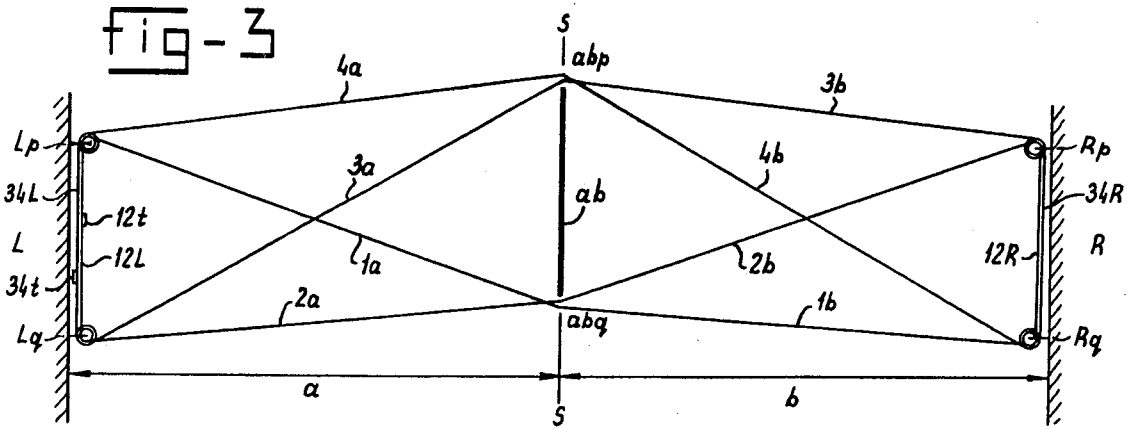
FIG. 3 shows the stiff flat girder according to FIG. 1, but designed with an endless cable circuit.
Figure 4:
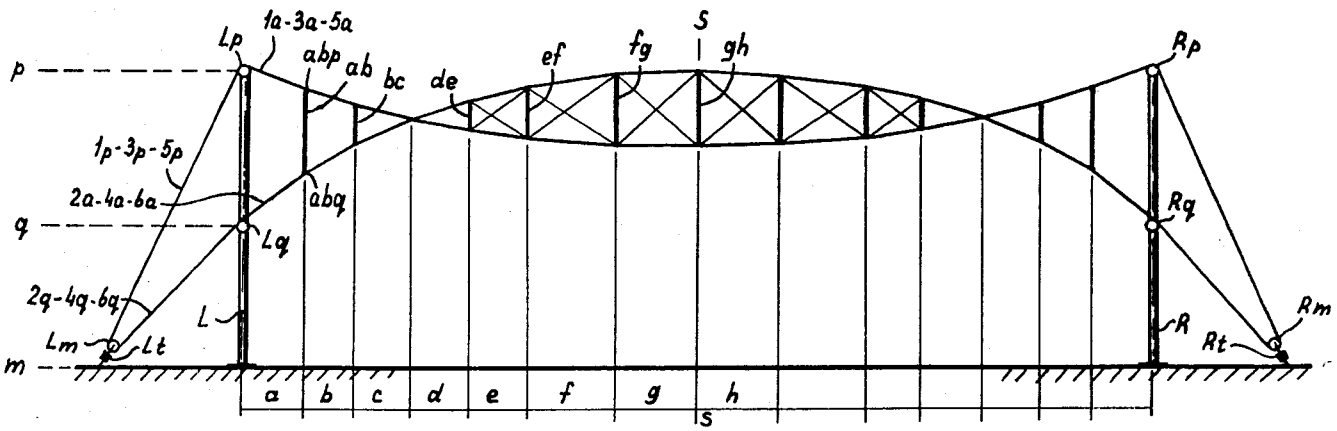
FIG. 4 shows a parabolic stiff girder according to the invention intended for a large span, with a large number of spacings and mutually crossing top- and bottom-chords and with endless cable circuits.
Figure 5A:
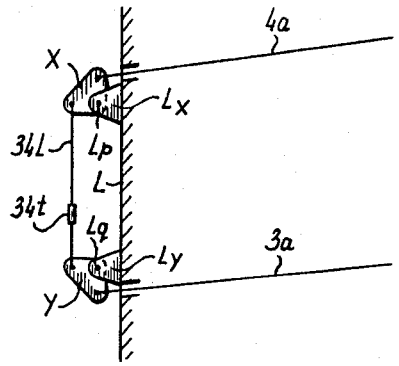
Figure 5B:
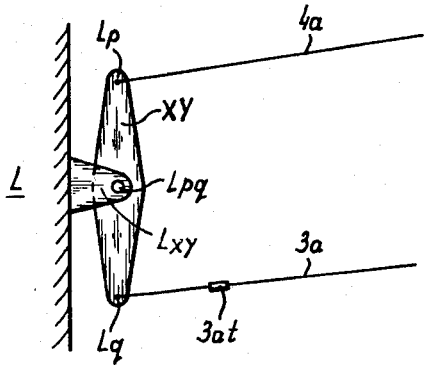
Figure 5C:
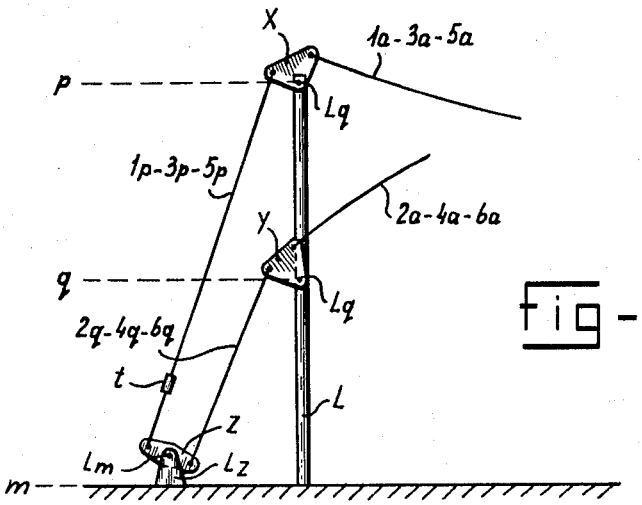

FIGS. 4*a*, 4*b* and 4*c* show the endless cable loops of three of the main cable circuits, each of which forms at least one diagonal bracing element. Together the FIGS. 4*a*+4*b*+4*c* form the girder according to FIG. 4. FIGS. 5*a*, 5*b* and 5*c* show an alternative embodiment of the girder according to FIGS. 3, 4, 4*a*, *b,c*, in which levers are introduced into the endless cable circuits.

Figure 6:
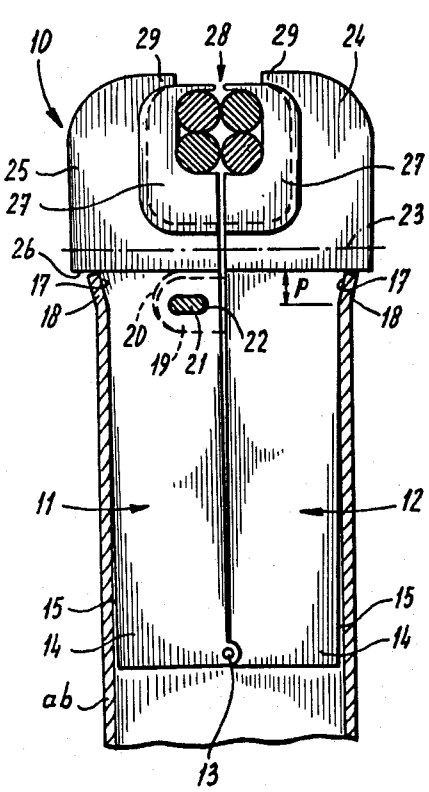

FIG. 6 shows, partly in section, a longitudinal view of a cable-clamp at the end of a compression member.

Figure 7:
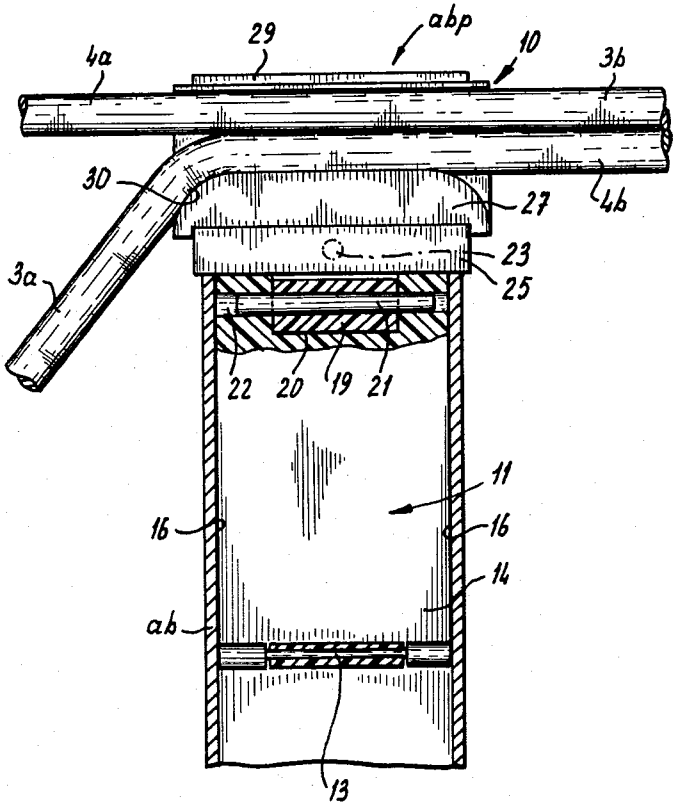

FIG. 7 shows, partly sectioned, a side view of the cable-clamp according to FIG. 6.

In both FIGS. 1 and 2 the girder with two, respectively six spacings, is connected to four fixed mountings. On the lefthand side of the drawing said fixed mountings are indicated with Lp and Lq and at the righthand side Rp and Rq. The fixed mountings ae schematically depicted with points in, for example, a concrete wall. These points may, however, also form part of, for example, a steel supporting structure. In all cases the supporting wall or steel structure L and R will have to withstand the net weight and the roof loading transmitted by the girder to the fixed mountings. The tension forces, however, for the cables need not be led to the ground through the supports L and R, for instance with the help of yoke- or column cables, but they may be transmitted to separate anchor blocks in the ground. Under said conditions the constructions L and R mainly perform a supporting function and may be of much lighter design, because they need to transmit only small bending moments.

In the Figures all cables run from left to right, thus all main cables, are indicated with numbers 1, 2, 3, etc. The spacings are indicated with the letters a, b, c, etc., and for each cable the part bridging a certain spacing, the spacing letter is added to the cable number: for instance 2*c* indicates the part of cable 2 which crosses the spacing c. In the Figures the stiff compression members forming the strut-bracings, are indicated with a combination of two letters, for instance bc, which means that said compression member bc forms the limit between the spacings b and c. The ends of the compression members all lie on the top chord or the bottom chord and are therefore indicated with the two letters of the compression member concerned, supplemented with p, q respectively, indicating the top- and the bottom chords respectively running between the top- and bottom fixed mountings.

In case secondary cables are present, as FIG. 2 illustrates, they are indicated according to the same system as with the main cables and their connecting points with the main cables are indicated with the letters r, s, t and u (FIG. 2). Whether a certain cable forms part of a main cable or a secondary cable, can only be read from the Figure and is not deducible from the numbers or letters used.

In both FIGS. 1 and 2 an even number of spacings are illustrated, making it possible to indicate a line of symmetry S—S in the middle of each girder. On said line a compression member is placed. It will be evident that also an uneven number of spacings in one girder is possible. Equally it is not necessary that the lefthand and righthand fixed mountings 1*p* and 1*q*, respectively rp and rq are positioned at the same mutual distance, while the use of more than two fixed mountings at the ends of the girder is possible as well.

In the Figures only the bracings ab up to ef are executed as stiff compression members. All other members consist of flexible cables/ropes.

To illustrate that the stiff and flat girders according to the invention need not exclusively have straight running bottom- and top chords, in FIG. 1 for example a roof-truss-girder is illustrated, in which at its topside the point abp is situated above the fixed mountings Lp and Rp. The compression member ab is longer than the distance between the fixed mountings Lp-Lq respectively Rp-Rq, resulting in a situation of the lower end abq of their compression member ab which is less raised above the connecting line Lq—Rq. In FIG. 1 nevertheless the point abq is positioned higher than said connection line, in order to get an esthetic effect when standing under the span, which avoids the impression of a downwardly vaulted span.

As follows from the codes in both Figures, all main cables follow at least once the path of a diagonal bracing cable, which leads to the main cables contributing basically to the stiffening of the girder and in supplying the carrying capacity of the girder. Nevertheless it can happen that certain cables run straight without changing direction at any of the points of intersection. In general, however, the secondary cables, like 6*c* and 6*d* in FIG. 2, will follow a change of direction as well, more especially at point cdq, but also near their ends s and t, where the secondary cable running from 6*b* and 6*c* changes its direction along the point bcp, respectively cable 6*d* to 6*e* at the point dep. As explained previously, the secondary cables transmit their tension forces to the main cables. At the points s and t (FIG. 2) the secondary cable 6 is tension-resistantly connected to the main cable 3. The same is true for the secondary cable 5, which at the points r and u is connected tension-resistantly to the main cable 1. With the exception of possible reaction points of the girder, none of the cable-ends are fixed to any end of a compression member. Substantially all cables continue at both sides of said ends of the compression members. For a number of passing cables said ends form the earlier mentioned points of change of direction (points of intersection), whilst for straight through running cables said ends do not form a point of intersection as far as their path is concerned. With a view to the manufacture and the assembly at the location of erection it is, however, preferable to fix all passing cables to each other and to the compression members at said end points of the members. This may for instance be done by means of plastic adhesive. The danger that particularly during assembly, the compression members might slightly shift in the plane of the girder, is avoided by this means.

All cables and compression members can be calculated exactly as far as effective length, loading, extension, etc. is concerned. From data made available by the manufacturer of the cables and from possible additional measurements, the characteristics of the cables are known. In contrast to single steel wires, which follow Hooke's law as far as their load-extension characteristic is concerned, flexible cable ropes undergo at low loads a "pre-stretching" before they follow Hooke's law. By taking this into account when fixing the final length of the cable in the girder design under service conditions, the pre-assembly load and the unloaded but stretched manufacturing length may be calculated exactly. Like the compression members, all cables may be manufactured in advance exactly to length and may be laid out on a flat assembly floor according to the designed circuit and in the calculated position. After all passing cables have been connected to the ends of the compression members, the girder is ready to be fixed to the fixed mountings by pretensioning all cables ending at said points. The pre-assembled girder, however, is not yet stiff and it may be reeled up like a rope ladder and transported in said form. A girder of several dozens of meters thus may be transported in a simple manner and may be off-reeled at the final location of erection. After connecting the girder to the fixed mountings, still in untensioned form, it is only necessary to tension each fixed mounting over the calculated length to get the required tension in the different cables of the girder. The girder has not only become stiff in doing so, but it is able as well to carry the calculated load. Apart from the safetly margins provided, under all load conditions in all cables at least a little tension will be maintained. Thus the girder remains stiff.

In FIG. 2 all compression members ab up to ef are drawn with equal length. Their length is furthermore equal to the distance between the fixed mountings Lp and Lq, respectively Rp and Rq. This, however, is no limitation. By choosing different lengths and positions for the compression members ab up to ef, a girder with roof-truss-shape may be formed, with subsequent different angles of the top chord and bottom chord. Even opposing angles are possible. It will be evident that the girder may also be executed as a concave, convex or concave-convex vault-shaped girder, as for instance FIG. 4 shows, which will be discussed below.

The girders according to FIGS. 3 and 4 are basically of the same type as those of FIGS. 1 and 2, but this time in an embodiment with endless cable circuit. According to FIG. 3 the girder is fitted to four fixed mountings. At the lefthand side of the drawing these are the points Lp and Lq and at the righthand side Rp and Rq. In FIG. 4 the same fixed mountings Lp, Lq and Rp, Rq are adopted, but with additional fixed mountings Lm and Rm, which relieve the columns L respectively R from the greater part of bending moments and which simplify as well the tensioning of the endless main cables. The columns L and R according to FIG. 4 may be clamped in the foundation, but they may also be held by non-illustrated guy cables connected to separate anchoring blocks in the ground.

In the Figures all endless cable circuits running from the lefthand side to the righthand side and back again, are indicated by the numbers 1, 2, 3, etc., the spacings are indicated with a, b, c, etc., whilst for each cable, for its part which crosses a certain spacing, the indication of the spacing is added to the indication of the cable: 2*c* indicates that part of cable 2 which traverses spacing c. It is pointed out that, in order to avoid confusion, certain cables in one spacing and indicated with different numbers, may belong to one and the same endless cable circuit. Near the lefthand and righthand fixed mountings it is easily visible and comrpehensible.

In the Figures the stiff compression members which form the strutlike bracings, are indicated with a combination of two letters, for instance bc, which means that said compression member follows the limit between the spacings b and c. The ends of the compression members all lie on the top chord and therefore they are indicated with the letters of the compression member concerned, with the addition of p and q respectively to indicate its position on the top or bottom level of the vertical mounting. In FIG. 2 the ground level is indicated with m, in which the non-illustrated but necessary anchoring blocks and foundations are situated.

In FIG. 3 the cable 1*a*, 1*b* continues at the righthand side as cable 12R to pass round the top fixed mounting Rp again to the left as cable 2*b* and 2*a* respectively, after which the endless cable circuit is closed by the part 12L between the fixed mountings Lp and Lq. To tension said endless cable a schematically indicated tensioning means 12*t* is introduced in the cable run 12L. Accordingly a separate endless cable is formed by the cables 3*a*, 4*b*, 24R, 3*b*, 4*a*, 34L with a tensioner 34*t* in the last run. If it is assumed that the cables are led over individual cable guides in the fixed mountings, which can rotate with controlled friction, then it will become clear that in each of both endless cable circuits at every point substantially the same tension will obtain. Thus the advantage is gained, that the load is divided over a greater number of cables and that load peaks in certain cables, as happens in conventional lattice girders, are avoided, whereas an appreciable unloading of other cables is avoided as well. The average load is reduced, creating the possibility to adopt thinner cables. With not illustrated known means, like cable stops, it can be assured that the cable can rotate only within certain limits round its fixed mounting. The same is true for the ends of the compression members, over which the cables pass through clamps. This will be explained in more detail below.

The manufacture at the factory of the endless cables is simplified because the prestretched cable has only to be marked at those places where connecting points, points of intersection or fixing points will be situated in service. The endless cables with their marks, factory-made to the correct length, can be laid out at the location of erection and fitted to the fixed mountings. The compression members may be fitted in advance on the floor or afterwards above the floor, according to circumstances. After all items have been brought to their correct position under a light pre-tension, the girder can be post-tensioned up to the service tension and the clamps at the end of the compression members may also be fastened, which will be discussed below. During the pre-assembly the cables still can be shifted mutually and with regard to the compression members, but after the application of the service tension and the service clamping, this is no longer possible, with the exception of an extraordinary overload.

In FIG. 3 in principle only two endless cables are necessary to form the roof-truss. In case of the girder according to FIG. 4 it will be evident that in the bottom- and top chord a number of endless main cables will have to run parallel with each other in order to form the different diagonal bracings by the endless main cables, as is fundamental according to the invention. Also in this case basically the same tension force will act over the total length of each endless cable circuit. At each side the fixed mountings consist of a top and a bottom rotatable cable guide Lp, Lq respectively Rp, Rq. The endless cable between both fixed mountings at the lefthand side respectively at the righthand side can be closed in a way according to FIG. 3. The column L respectively R, however, will be loaded heavily and it will have to be supported sideways by non-illustrated guy-cables or the like, to reduce the bending moments in the columns. This complication can be avoided by closing the endless cable circuit between the top chord and bottom chord through an additional third fixed mounting Lm respectively Rm at the ground level, where the tensioners Lt and Rt may be positioned as well.

For the sake of clarity, in FIG. 4 only some of the elements with which the girder is built are indicated with indices. The girder according to FIG. 4 is built up with the individual endless cable circuits illustrated in FIGS. 4*a*, 4*b* and 4*c*. The final construction according to FIG. 4 consists of the combination of all that which is depicted in FIGS. 4*a*, 4*b* and 4*c*, as far as the cables are concerned. Furthermore it will be evident that the illustrated parabolic girder is symmetrical about its middle line S—S and that it is therefore sufficient to describe only one half of it (the lefthand half). When combining the endless cable circuits depicted in FIGS. 4*a*, 4*b* and 4*c* it becomes clear that round the fixed mountings Lp, Lq and Lm therefore three parallel endless cable circuits 1-2, 3-4, 5-6 pass, each of which is led round on individual rotatable cable guides. Depending on the possible accuracy during manufacture and from the service loadings, one can choose for individual tensioners Lt for each endless cable, but in many cases it will be possible to tension all three endless cable circuits with one tensioner Lt.

From combination of the FIGS. 4*a*, 4*b* and 4*c* it can be seen that almost all diagonal bracings are formed by the endless cable circuits. Depending on the chosen member of cable circuits, the number of spacings, etc., the path followed by each endless cable circuit may be variable from building to building. As appears from the example illustrated in FIG. 4, with only three endless cable circuits already a large span with many spacings may be erected.

For the sake of clarity the diagonal bracing cables in the spacings a, b, c and d are not illustrated in FIGS. 4, 4*a,b,c*. Although the connection between the spacing c to the spacing d is stiff according to the requirements for a stiff girder, because both the lefthand part (spacings a, b, c) and the middle part (spacings d-g) each are stiff, this connection may be stiffened additionally by applying non-illustrated "diagonal" bracing cables bcp-deq and bcq-dep, which on first impression do not, but functionally, do form diagonal bracings indeed. At these points the top- and bottom chords cross each other.

The FIGS. 5*a*, 5*b*, 5*c* show alternative embodiments for the fixed mountings adapted for the endless cable circuits according to FIGS. 3 and 4. In order to completely exclude slight but repeated bending of the cables led round the fixed mounting guides, these guides are replaced by levers of adapted shape. Each lever is, comparably with the guides, pivotingly mounted with controlled friction on shafts or pins Lp, Lq or Lm in the fixed mountings. To each end of each lever X, Y, Z a cable is pivotingly with controlled friction connected with known cable-end connections which are not illustrated. The endless cable circuit is, by doing so, interrupted as to its structure but functionally remains unimpaired by the introduction of the levers, avoiding every risk of repeated bending of one or more of the cables. Said cables may therefore be loaded up to the normal limits accepted for static structures, which are appeciably higher than for dynamic structures in which the cables repeatedly are bent.

For clarity the tensioners . . . t are drawn in the endless cable circuits, but it will be clear to the expert that also other known solutions are applicable. Also the shape of the levers is only illustratively meant. The consoles for the pivoting shafts of the levers are only schematically indicated with Lx, Ly, Lxy and Lz. The other indices correspond with the same in the other drawings.

FIGS. 6 and 7 show two views of a preferred design of the construction between the ends of the compression members and the cables passing over said ends. As an example the compression member ab is illustrated according to FIGS. 1 or 3, of which the top end abp is depicted in FIGS. 6 and 7. At the point abp four cables pass, which for example are drawn in FIGS. 6 and 7 as well. For the compression member a commerciably available steel or aluminum hollow square section-member is used. At the top- and bottom ends of the compression member ab, of which only the top end is illustrated, a cable clamp 10 is introduced. The clamp consists of two halves 11 and 12, which pivot at 13 near to their insert-end 14, connected with each other. The outside of the shaft of the insert or female end is slightly conical, a narrowing slot 15 (FIG. 6) is formed and the insertion of the cable clamp in the compression member over the first part is easily made. In the side view according to FIG. 7 a slight clearance 16 is present with constant width. Over the last part p, the insert end has a steeper cone, which opens up to a width under the clamping jaws 24 and 25, which wedges the clamp into the compression member ab. Over the last portion p the cable clamp has to be introduced into the compression member ab with considerable force or blows.

The end of the cable clamp extending from the compression member ab consists of the clamping jaws 24 and 25, which each have at their outer end a recess to take cable protecting fixing blocks 27. The latter have a number of grooves, four in the example, which are adapted to the number and the size of the passing cables to be clamped. These fixing blocks 27 can be made of plastic or an other relatively soft material, in which the cables may be clamped firmly, but without damage to them. Under certain conditions of overload one or more cables should be able to move slightly through the fixing blocks without suffering damage. At the end of the compression member ab both the fixing blocks 27 and the clamping jaws 24 and 25 are rounded by using as little material 29 as possible. A stiff roof covering which rests on the cables and even may envelope them partially, should be applied as smoothly as possible over the ends of the cable clamps. In case the connecting point abp forms for one or more of the cables a point of change of direction, as is the case for the cable 3*a*-4*b*, it is of advantage to round the ends of the fixing blocks 27 as is illustrated at 30.

During the pre-assembly the cables are only slightly clamped by the cable-clamps for which reason the two halves are provided with a wedge-and-slot assembly 19, 20, through which a slot 22 extends to take a conical wedge 21. By inserting more or less of the wedge the pre-tension on the cables can be adjusted. After the pre-assembly has been completed, during which all cables and all compression members ab are brought to their correct position and direction, the girder is brought to the service tension. The clamping force on the cables has to be augmented appreciably during said production step, which is achieved by inserting the cable clamps deeper into the compression member over the portion p. The cone-shaped end 17 of the female end will wedge itself into the end of the compression member and the latter may be widened elastically and/or plastically by this action, as is indicated with 18 in an exaggerated way. The compression member ab is calculated to resist buckling and according to this calculation the profile and thickness of the material is chosen. If the wall thickness is not sufficient to create sufficient clamping force at 17-18, to create a sufficient clamping force on the cables, then an extra clamping bolt may be applied, which schematically is indicated with the dotted line 23.

Thanks to the application of the fixing blocks 27 with one and the same pair of cable clamps 10, different cables, cable combinations and cable sizes may be clamped, with the result that a reduced number of differently sized standard cable clamps may be used for a great variety of girders. In many cases the cable clamps will be made of metal, but partial or total use of plastics should not be excluded.

I claim:

1. In a stiff flat girder with at least two spacings, consisting of a top- and a bottom chord, compression members between the top and bottom chord and diagonal bracings in the spacings, with at least four fixed mountings, two of which are at each end, in which the fixed mountings are situated in the plane of the girder and the load acts in the plane of the girder and substantially perpendicular to the girder and in which the fixed mountings are adapted to withstand, apart from the service loading, tensional forces in the direction of the girder; the improvement in which the top chord (p) and the bottom chord (q) of the girder and the diagonal bracings each consist of at least one flexible cable/rope, in which—excluding the fixed mountings (Lp, Lq, Lm, Rp, Rq, Rm)—said compression members (ab, bc, cd, . . . ) act as struts and are fitted between the top and bottom chord-cables (p, q) at those corresponding points-of-intersection (abp, abq, bcp, bcq, . . . ) at which diagonal bracing cables join the top and bottom chord-cables, and in which at least one said chord-cable continues uninterruptedly between mutually facing fixed mountings and follows at least once the direction of a said diagonal bracing.

2. Girder according to claim 1, characterized in that one or more secondary cables (5, 6; FIG. 2) are applied, which at least once diagonally change over from a point-of-intersection on the one chord (p, q) to a point-of-intersection on the other chord (q, p), whereby at least one end of the secondary cable in a tension-resistant way is connected to a main cable (1, 2, 3, 4, 5), for instance by means of cable clamps (r, s, t, u).

3. Girder according to claim 1, characterized in that in a girder with several spacings (a, b, c, . . . ) some of the cable-elements consist of more than one parallel cable.

4. Girder according to claim 1, characterized in that the stiff compression members (ab, bc, cd, . . . ) are placed substantially perpendicular to the chords.

5. Girder according to claim 1, characterized in that in the points-of-intersection at the ends of each stiff compression member the cables passing said points are fixed in said points to the compression members, for instance by means of a hardening plastic material.

6. Girder according to claim 1, characterized in that each time one of the main cables (4; 1, 3, 5) of the top chord (p) and one of the main cables (2; 2, 4, 6) of the bottom chord (q) endlessly continue into each other (34L, 12L; 1*p*-3*p*-5*p*, 2*q*-4*q*-6*q*), being guided round the fixed mountings (Lp, Lq, Lm) with controlled friction, and in that at least one tensioning means (12T, 34T; Lt; Lt) is included in each of said endless cable-circuits.

7. Girder according to claim 6, characterized in that the tensioning means consists of at least one additional adjustable fixed mounting (Lm), which is situated in the endless cable-circuit between the fixed mountings (Lp, Lq) at the same end of the girder and round which the cable-circuit is guided with controlled friction.

8. Assembly of stiff flat girders, characterized in that a number of girders according to claim 1 are joined by the top chord of one girder with the bottom chord of another girder such that three-dimensional girders are formed, with triangular or rectangular cross-section.

9. Girder according to claim 1, in which the compression member is formed by a hollow square section member, characterized in that the connecting structure between the end of the compression member and the cables passing said end, consists of a cable-clamp, of which the two mutually pivoting halves form a female endpart adapted to be inserted into the compression member, in that the side of the endpart adjacent to the clamp conically opens up to a width which wedges into the compression member, in that the end extending from the compression member forms two clamping-jaws for holding at least one cable, and in that the cable clamp is provided with a cooperating wedge-and-slot assembly in order to achieve a slight pre-assembling clamping action by insertion of the wedge, before the conical part of the female end is inserted permanently into the compression member beam in order to increase the preclamping to the permanent service-clamping-force.

10. Girder according to claim 9, characterized in that the cable-clamp has clamping-jaws of such internal width, that a pair of cable protecting fixing blocks are interchangeably enclosed between them, said fixing blocks having grooves adapted to the number and size of the passing cables to be clamped.

* * * * *